US005099620A

United States Patent [19]

Carey

[11] Patent Number: 5,099,620

[45] Date of Patent: Mar. 31, 1992

[54] RAIN GUTTER COVER

[76] Inventor: Robert J. Carey, P.O. Box 403, Middletown, N.J. 07748

[21] Appl. No.: 656,581

[22] Filed: Feb. 19, 1991

[51] Int. Cl.[5] ..... E04D 13/06

[52] U.S. Cl. ..... 52/12

[58] Field of Search ..... 52/11-16

[56] References Cited

U.S. PATENT DOCUMENTS

| | | | |
|---|---|---|---|
| 2,271,081 | 1/1942 | Layton | 52/12 |
| 2,674,961 | 4/1954 | Lake | 52/12 X |
| 3,388,555 | 6/1968 | Foster | 52/12 X |
| 4,411,110 | 10/1983 | Carey | 52/11 |
| 4,450,654 | 5/1984 | Clendenin | 52/12 |
| 4,592,174 | 6/1986 | Hileman | 52/12 |
| 4,616,450 | 10/1986 | Showe | 52/12 |
| 4,631,875 | 12/1986 | Olson | 52/12 |
| 4,667,448 | 5/1987 | Smith | 52/12 |
| 4,876,827 | 10/1989 | Williams | 52/12 |

*Primary Examiner*—Richard E. Chilcot, Jr.
*Attorney, Agent, or Firm*—R. Gale Rhodes, Jr.

[57] ABSTRACT

Rain gutter cover for being mounted adjacent the bottom edge of a roof upon which rain falls, the rain gutter cover is for preventing entrance into the rain gutter of leaves and other debris which cause rain gutter clogging and the stoppable of rain flow into downspouts. the cover includes a generally angular upper portion, a generally horizontal bottom portion, and a generally vertical intermediate portion intermediate and interconnecting the upper and bottom portions; the generally angular upper portion is for transferring rain from the roof to the intermediate portion; the generally vertical intermediate portion is provided with a plurality of longitudinal extending, generally horizontally disposed rows of interrupted slots, the interruptions between the slots in each row being displaced horizontally with respect to the interruptions between the slots of the next adjacent row of slots such that there is no generally vertical path of rain flow down the intermediate portion which is not interrupted by at least one of the slots, the intermediate portion further provided with a plurality of generally inwardly and downwardly extending fins provided along the top edges of the slots and with a plurality of shelves interconnecting the bottom edges of the fins and slots, the fins for receiving rain flowing down the intermediate portion and for diverting the rain onto the shelves and the shelves are for diverting the rain into the rain gutter, the shelves prevent leaves and other debris from entering the rain gutter.

5 Claims, 2 Drawing Sheets

RAIN GUTTER COVER

BACKGROUND OF THE INVENTION

This invention relates to a new and improved rain gutter cover for being mounted on top of a rain gutter and for preventing entrance into the rain gutter of leaves and other debris which cause rain gutter clogging and the stoppage of rain flow into downspouts or leaders.

As is known to those skilled in the rain gutter art, and as is particularly well known to homeowners having plants or shrubs in their yards close to their house, rain gutters are notorious for collecting leaves and other debris which clog the rain gutter and prevent rain flow into the downspouts or leaders whereby the rain gutter overflows and the rain falls down washing away soil adjacent the house, or other building, and frequently washing soil away from plants or shrubs adjacent the house or other building, and possibly causes entrance of rain into the basement of the house or building.

As is further known to those skilled in the rain gutter art, the rain gutter art is replete with various prior art structures for being mounted atop to the typical open prior art rain gutter for preventing leaves and other debris from collecting in the rain gutter. Such other structures are typified by screen or mesh material which is placed over the top of the open rain gutter to prevent the entrance and accumulation of leaves and other debris. However, since the screen or mesh material is placed on the top of the open prior art rain gutter, leaves, or at least leaf particles, and other debris do enter through the openings in the screen or mesh material and, in time, do cause rain gutter clogging and prevention of rain flow through the downspouts or leaders.

Another problem associated with such prior art screen or mesh material is that it has sharp edges which can puncture and cut the hands of the person installing the material and, such screen or mesh material is often damaged in the process of being removed. Further, upon the rain gutter being clogged underneath such installed screen or mesh material, it is extremely difficult, aggravating and annoying to have to frequently remove the screen or mesh material, clean the leaves or other debris out of the rain gutter, and then replace the screen or mesh material.

Accordingly, there exists a need in the rain gutter art for a new and improved rain gutter cover which, upon being mounted on top of the rain gutter requires virtually no further maintenance, or at most very limited further maintenance, which virtually eliminates the need for constant cleaning and unclogging, and which provides substantially uninterrupted flow of rain through the rain gutter to the downspouts or leaders.

Further, there exists a need in the art for a relatively inexpensive device or apparatus for preventing the above-noted rain gutter clogging due to leaves and other debris which falls into the typical prior art rain gutter open at the top. While the RAIN GUTTER disclosed in U.S. Pat. No. 4,411,110 patented Oct. 25, 1983, and the LEADER FILTER disclosed in U.S. Pat. No. 4,615,153 patented Oct. 7, 1986, both issued patents to the same inventor, Robert J. Carey, as the inventor of the present invention, are effective for preventing such clogging, etc., there still exists a need in the art for a comparatively less expensive device or apparatus providing the same prevention of rain gutter clogging which allows the homeowner to buy the cover only instead of the entire gutter as disclosed in U.S. Pat. No. 4,411,110.

SUMMARY OF THE INVENTION

The new and improved rain gutter cover of the present invention satisfies the above-noted needs in the prior art and is for being mounted over the top of a rain gutter attached to a building adjacent the bottom edge of a roof upon which rain falls, and includes a generally angular upper portion, a generally horizontal bottom portion, and a generally vertical intermediate portion intermediate and interconnecting the upper and bottom portions, the generally angular upper portion is for interconnecting with the bottom edge of the roof and is for transferring rain from the roof to the intermediate portion, the generally vertical intermediate portion is provided with a plurality of longitudinally extending, generally horizontally disposed rows of interrupted slots, the interruptions between the slots in each row being displaced horizontally with respect to the interruptions of the slots of the next adjacent row of slots such that there is no generally vertical path of rain flow down the intermediate portion which is not interrupted by at least one of the slots, the intermediate portion is further provided with a plurality of generally inwardly and downwardly extending fins provided along the top edges of the slots and with a plurality of shelves interconnecting the bottom edges of the fins slots, the fins are for receiving rain flowing down the intermediate portion and for diverting the rain onto the shelves and the shelves are for diverting the rain into the rain gutter; the shelves prevent the entrance of leaves and other debris into the rain gutter.

DESCRIPTION OF THE PREFERRED EMBODIMENTS

Figure 1:
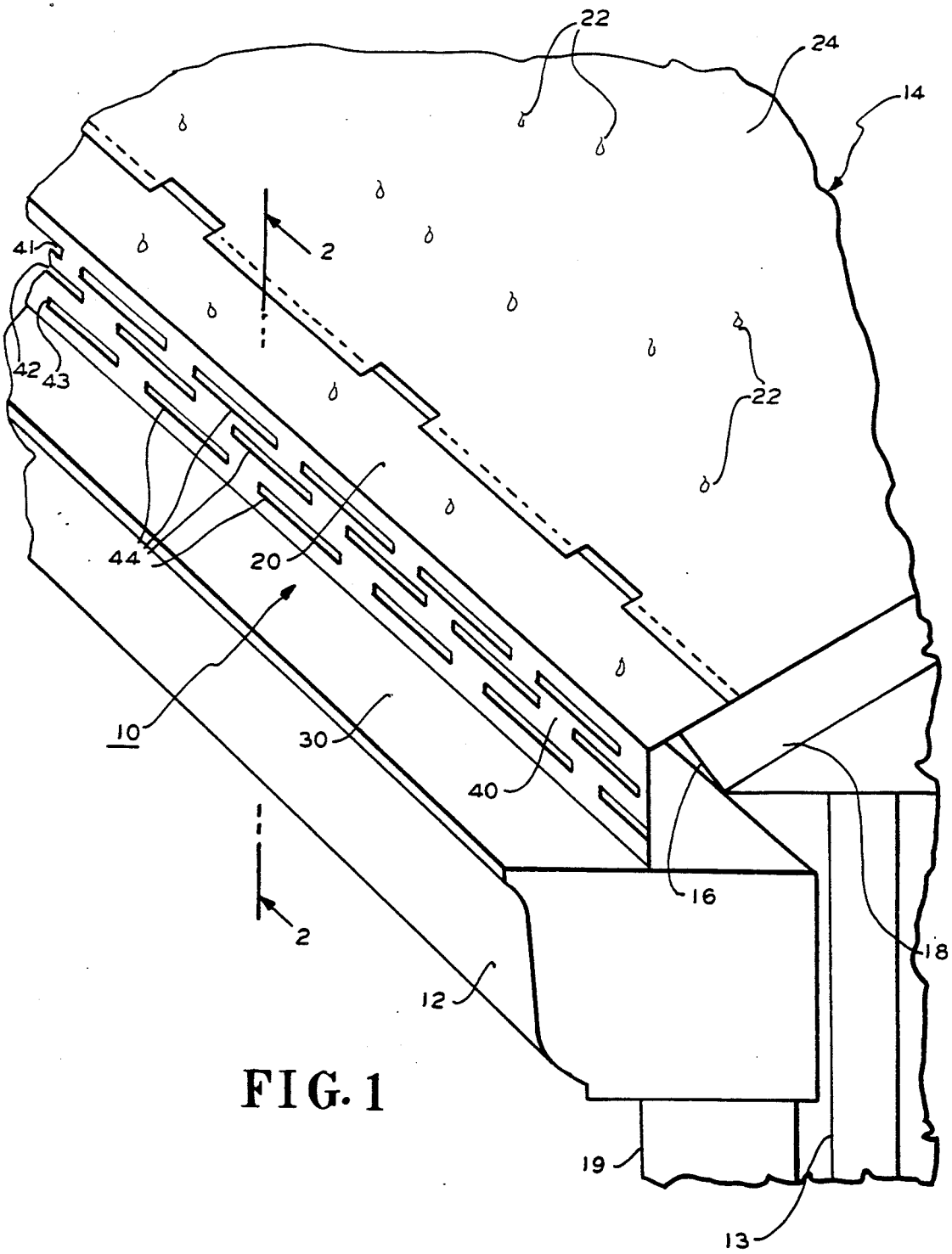
FIG. 1 is a diagrammatic view, in perspective, of a rain gutter cover embodying the present invention shown mounted on the top of a rain gutter attached to a building, the view being a partial perspective view.

Referring now to FIG. 1, there is shown a rain gutter cover embodying the present invention and indicated by general numerical designation 10. The rain gutter cover 10 is for being mounted on top of a rain gutter 12 attached to a facial board 13 of a building 14 adjacent the bottom edge 16 of a roof 18 upon which rain falls. Generally, it will be understood that the rain gutter cover 10 is for preventing entrance into the rain gutter 12 of leaves and other debris which cause rain gutter clogging and the stoppage of rain flow into down spouts or leaders such as leader 19 in FIG. 1.

Figure 2:
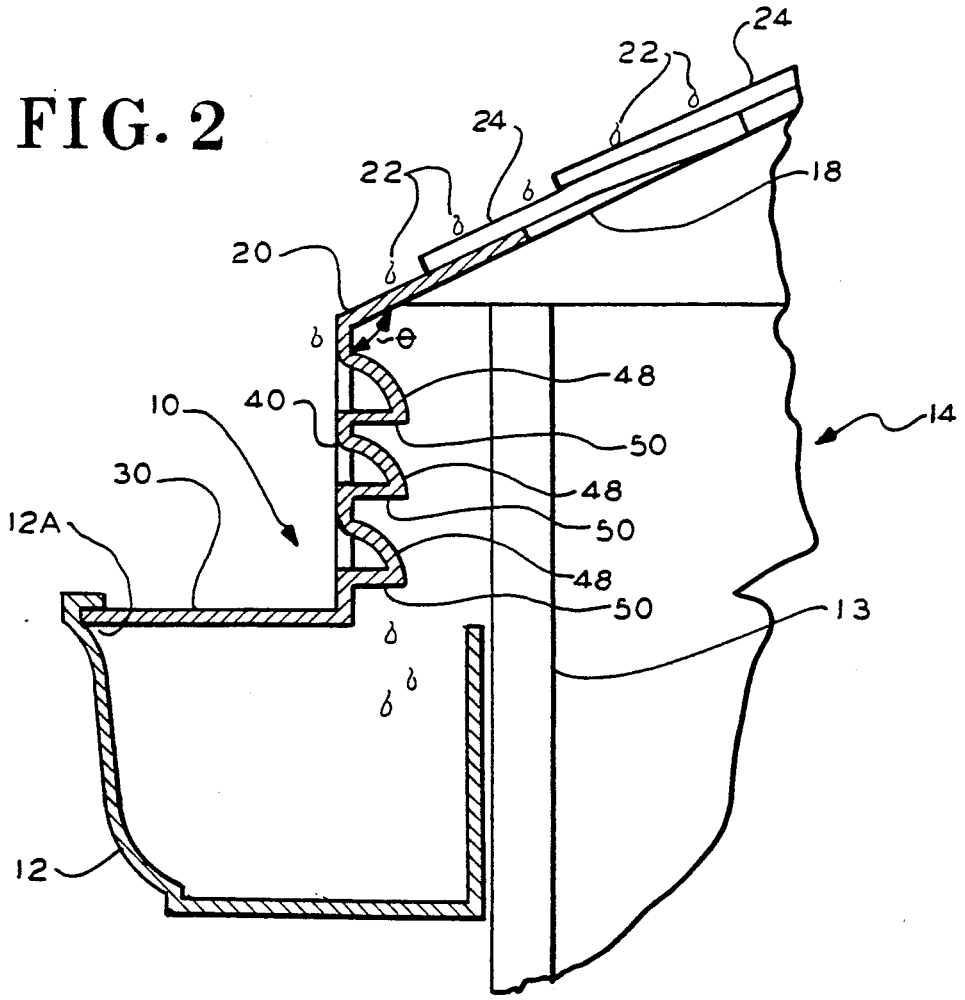
FIG. 2 is a cross-sectional view taken along the line 2—2 in FIG. 1 and in the direction of the arrows.

As may be understood by reference to both FIGS. 1 and 2, rain gutter cover 10 includes a generally angular upper portion 20, a generally horizontal bottom portion 30, and a generally vertical intermediate portion 40 intermediate and interconnecting the upper and bottom portions.

The upper angular portion 20, as may be best seen in FIG. 2, is inclined at an included angle $\theta$ with respect to the vertical intermediate portion 40 to orient the upper angular portion 20 generally parallel to the roof 18; the upper angular portion 20 is for transferring rain, represented by rain drops 22, from the roof 18, which may be covered by shingles 24, to the intermediate portion 40.

As also best may be seen in FIG. 1, the vertical intermediate portion 40 is provided with a plurality of longitudinally extending, generally horizontally disposed rows 41, 42 and 43 of interrupted slots 44, the interruptions between the slots in each row being displaced horizontally with respect to the interruptions between the slots of the next adjacent row of slots such that there is no generally vertical path of rain flow down the vertical intermediate portion 40 which is not interrupted by at least one of the slots 44.

As is further shown in FIG. 2, the intermediate portion 40 is further provided with a plurality of generally inwardly and downwardly extending fins 48 provided along the top edges of the slots 44. Still further, the intermediate portion is provided with a plurality of ledges or shelves 50 interconnecting the bottom edges of the fins and the bottom edges of the slots as shown in FIG. 2. The fins 48 are for receiving rain 22 flowing down the vertical intermediate portion 40 and for diverting the rain onto the shelves 50 and the shelves 50 are for diverting the rain into the rain gutter 12 through openings provided at opposite ends of the fins 48 and shelves 50. The shelves 50 prevent entrance into the rain gutter 12 of leaves and other debris.

Referring still to FIG. 2, it will be understood that the upper and intermediate portions 20 and 40 cover a portion of the top of the rain gutter 12 and the bottom horizontal portion 30 covers the balance of the top of the rain gutter 12.

Figure 3:
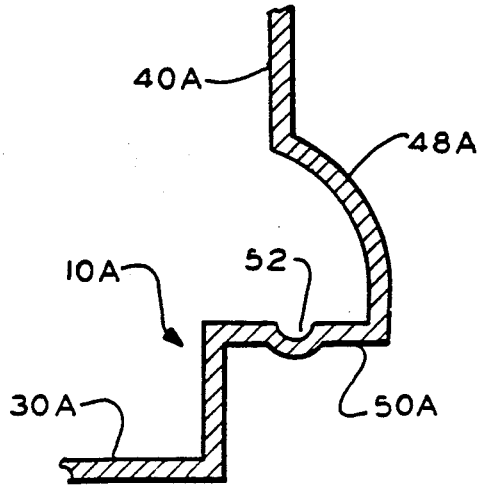
FIGS. 3 and 4 are partial cross-sectional views, similar to a portion of FIG. 2, and show alternate embodiments of rain gutter covers according to the present invention.

A further embodiment of a rain gutter cover embodying the present invention is shown in partial view in FIG. 3 and indicated by general numerical designation 10A. This embodiment is the same as the earlier embodiment except that the representative ledge or shelf 50A is provided with at least one groove 52 for facilitating flow along the shelf 50A and into the openings provided at opposite ends of the fins and shelves and therefrom into the rain gutter 12 (FIG. 2).

Figure 4:
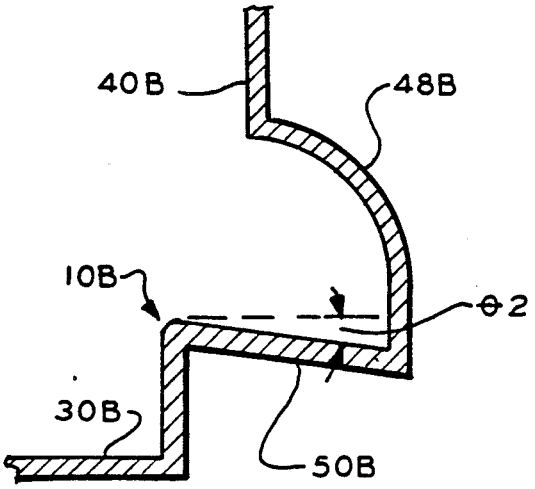

FIG. 4 illustrates a still further embodiment of a rain gutter cover embodying the present invention. In this embodiment, the shelves, e.g. representative shelf 50B, are inclined downwardly with respect to the horizontal at an angle $\theta 2$. This inclination facilitates flow of the rain along the shelf 50B and into the rain gutter 12 (FIG. 2) through openings provided at the opposite ends of the fins 48B and shelves 50B.

With regard to manufacture of the rain gutter cover embodiments of the present invention, it will be understood by those skilled in the art that the angular upper portion 20, generally horizontal bottom portion 30, and generally intermediate vertical portion 40, may be made from separate pieces of material, suitably shaped and joined together in the manner known to those skilled in the art or, in the preferred embodiment, the upper, bottom and intermediate portions may be formed integrally from a single piece of material, such as PVC or aluminum, and suitably shaped as shown in cross-section in FIG. 3 by means well known to those skilled in the art. Still further, it will be understood by those skilled in the art that the fins 48 and shelves 50 of FIG. 2 preferably may be formed integrally with the intermediate portion 40 by stamping or die cutting the fins and shelves out of the material of the intermediate portion 40 and by bending or shaping the fins inwardly and downwardly and shelves inwardly to the positions shown in FIG. 2; the slots 44 will then be formed or provided in the spaces in the intermediate portion 40 where the fins 48 and shelves 50 have been pushed inwardly and the fins downwardly.

It further will be understood by those skilled in the art that many modifications and variations of the present invention may be made without departing from the spirit and the scope thereof.

What is claimed is:

1. Rain gutter cover for being mounted over the top of a rain gutter attached to a building adjacent the bottom edge of a roof upon which rain falls, said rain gutter cover for preventing entrance into the rain gutter of leaves and other debris which cause rain gutter clogging and the stoppage of rain flow into downspouts, comprising:

a generally angular upper portion, a generally horizontal bottom portion, and a generally vertical intermediate portion intermediate and interconnecting said upper and bottom portions;

said generally angular upper portion for being mounted adjacent said bottom edge of said roof and for transferring rain from said roof to said intermediate portion;

said generally vertical intermediate portion provided with a plurality of longitudinally extending, generally horizontally disposed rows of interrupted slots, the interruptions between the slots in each row being displaced horizontally with respect to the interruptions between the slots of the next adjacent row of slots such that there is no generally vertical path of rain flow down said intermediate portion which is not interrupted by at least one of said slots, said slots having top and bottom edges, said intermediate portion further provided with a plurality of generally inwardly and downwardly extending fins provided along the top edges of said slots and said fins having bottom edges, and said intermediate portion further provided with a plurality of generally horizontal shelves intermediate said bottom edges of said slots and said bottom edges of said fins, said fins for receiving rain flowing down said intermediate portion and for diverting said rain onto said shelves and said shelves for diverting said rain into said rain gutter, said shelves for preventing the entrance into said rain gutter of said leaves and other debris; and said upper and intermediate portions covering a portion of the top of said rain gutter and said bottom portion covering the balance of the top of said rain gutter.

2. Rain gutter cover according to claim 1 wherein said fins and shelves are formed integrally with said intermediate portion by stamping or die cutting said fins and shelves out of said intermediate portion and by bending said fins and shelves generally inwardly, and wherein said slots are formed in the spaces in said intermediate portion where said fins and shelves have been pushed inwardly.

3. Rain gutter cover according to claim 1 wherein said shelves are provided with at least one downwardly extending groove extending longitudinally thereof in the direction of said rain gutter for facilitating flow therealong of said rain into said rain gutter.

4. Rain gutter cover according to claim 1 wherein said shelves are inclined downwardly at a predetermined angle with respect to the horizontal to facilitate flow therealong of said rain into said rain gutter.

5. Rain gutter cover according to claim 4 wherein said predetermined angle is about 3° to 5°.

* * * * *